US005709587A

United States Patent [19]

Shaffer

[11] Patent Number: 5,709,587

[45] Date of Patent: Jan. 20, 1998

[54] METHOD AND APPARATUS FOR HONING AN ELONGATE ROTARY TOOL

[75] Inventor: William R. Shaffer, Greensburg, Pa.

[73] Assignee: Kennametal Inc., Latrobe, Pa.

[21] Appl. No.: 620,820

[22] Filed: Mar. 25, 1996

[51] Int. Cl.[6] ..... B24B 1/00

[52] U.S. Cl. ..... 451/38; 451/39; 451/40; 451/82; 76/108.6

[58] Field of Search ..... 451/38, 39, 40, 451/75, 82, 89, 91, 48, 5, 79; 76/5.1, 108.6

[56] References Cited

U.S. PATENT DOCUMENTS

| | | | |
|---|---|---|---|
| D. 241,463 | 9/1976 | Ashworth | D15/126 |
| D. 246,108 | 10/1977 | Ashworth | D15/124 |
| 2,497,021 | 2/1950 | Sterns | 51/8 |
| 2,583,726 | 1/1952 | Chalom | 51/282 |
| 2,774,193 | 12/1956 | Thatcher | 51/59 |
| 3,039,234 | 6/1962 | Balman | 51/2 |
| 3,103,084 | 9/1963 | Ashworth | 51/8 |
| 3,160,106 | 12/1964 | Ashworth | 103/103 |
| 3,211,101 | 10/1965 | Ashworth et al. | 103/103 |
| 3,270,463 | 9/1966 | Ashworth et al. | 51/8 |
| 3,286,406 | 11/1966 | Ashworth | 51/8 |
| 3,298,137 | 1/1967 | Ashworth | 51/8 |

(List continued on next page.)

FOREIGN PATENT DOCUMENTS

| | | |
|---|---|---|
| 965513 | 7/1964 | United Kingdom . |
| 1040062 | 8/1966 | United Kingdom . |
| 1043199 | 9/1966 | United Kingdom . |
| 1056381 | 1/1967 | United Kingdom . |
| 1070233 | 6/1967 | United Kingdom . |
| 1070234 | 6/1967 | United Kingdom . |
| 1086934 | 10/1967 | United Kingdom . |
| 1087931 | 10/1967 | United Kingdom . |
| 1087932 | 10/1967 | United Kingdom . |
| 1090407 | 11/1967 | United Kingdom . |
| 1184052 | 3/1970 | United Kingdom . |
| 1236205 | 6/1971 | United Kingdom . |
| 1246132 | 9/1971 | United Kingdom . |
| 1247339 | 9/1971 | United Kingdom . |
| 1247701 | 9/1971 | United Kingdom . |
| 1263246 | 2/1972 | United Kingdom . |
| 1266140 | 3/1972 | United Kingdom . |
| 1308611 | 2/1973 | United Kingdom . |
| 1320133 | 6/1973 | United Kingdom . |
| 1367047 | 9/1974 | United Kingdom . |
| 1410451 | 10/1975 | United Kingdom . |
| 1423826 | 2/1976 | United Kingdom . |
| 1431044 | 4/1976 | United Kingdom . |
| 1474374 | 5/1977 | United Kingdom . |

OTHER PUBLICATIONS

S. P. Parker, Editor, "McGraw–Hill Dictionary of Scientific and Technical Terms," Fourth Edition, (1989) p. 297, col. 1.

Simon and Schuster, "The Way Things Work: An Illustrated Encyclopedia of Technology", 1967, pp. 376–379.

"The Oxford–Duden Pictorial German–English Dictionary", Second Edition, Clarendon Press–Oxford (1994), pp. 284–285.

Wülsag, Sandmaster® Strahltechnik Quotation, "Micro–sandblasting installation Sandmaster Type 80 S Precision micro–sandblasting machine for micro–surface treatment suitable to blast also with micro–grainings (e.g. 10 my)".

*Primary Examiner*—Robert A. Rose
*Assistant Examiner*—George Nguyen
*Attorney, Agent, or Firm*—Stanislav Antolin

[57] ABSTRACT

A method of, and apparatus for, treating an elongate rotary tool that presents a sharp cutting edge are described. The method includes the steps of emitting under pressure from a nozzle an abrasive fluid stream comprising an abrasive grit entrained in a fluid; and impinging the abrasive fluid stream against the sharp cutting edge of the elongate rotary tool for a preselected time so as to transform the sharp cutting edge into a relatively uniformly honed edge. The apparatus includes a rotatable fixture that releasably holds the elongate rotary tool. A nozzle that emits under pressure an abrasive steam. The nozzle and the elongate rotary tool are relatively moveable so that the abrasive stream impinges the entire length of the sharp cutting edge.

21 Claims, 8 Drawing Sheets

U.S. PATENT DOCUMENTS

| | | | |
|---|---|---|---|
| 3,307,296 | 3/1967 | Ashworth | 51/8 |
| 3,372,704 | 3/1968 | Ashworth | 134/109 |
| 3,407,539 | 10/1968 | Ashworth | 51/11 |
| 3,416,934 | 12/1968 | McNair | 106/38.24 |
| 3,426,378 | 2/1969 | Ashworth | 15/3 |
| 3,521,412 | 7/1970 | McCarty | 51/317 |
| 3,584,841 | 6/1971 | Field | 259/95 |
| 3,611,636 | 10/1971 | Trout | 49/181 |
| 3,611,640 | 10/1971 | Ashworth | 51/8 |
| 3,634,973 | 1/1972 | McCarty | 51/2 R |
| 3,640,023 | 2/1972 | Field et al. | 51/8 |
| 3,728,821 | 4/1973 | Perry | 51/2 R |
| 3,763,602 | 10/1973 | Boettcher | 51/317 |
| 3,802,128 | 4/1974 | Minear, Jr. et al. | 51/2 R |
| 3,819,343 | 6/1974 | Rhoades | 51/302 |
| 3,823,514 | 7/1974 | Tsuchiya | 51/281 P |
| 4,203,257 | 5/1980 | Jamison et al. | 51/2 R |
| 4,274,598 | 6/1981 | Wilfert et al. | 239/585 |
| 4,280,302 | 7/1981 | Ohno | 51/7 |
| 4,687,142 | 8/1987 | Sasao et al. | 239/533.3 |
| 5,065,511 | 11/1991 | Graf | 29/895 |
| 5,090,870 | 2/1992 | Gilliam | 416/241 R |
| 5,125,191 | 6/1992 | Rhoades | 51/317 |
| 5,251,468 | 10/1993 | Lin et al. | 72/53 |
| 5,325,747 | 7/1994 | Santhanam et al. | 82/1.11 |
| 5,341,602 | 8/1994 | Foley | 51/2 R |
| 5,467,505 | 11/1995 | Graf | 19/114 |
| 5,573,445 | 11/1996 | Rasmussen et al. | 451/39 |

METHOD AND APPARATUS FOR HONING AN ELONGATE ROTARY TOOL

BACKGROUND

The invention concerns a method of treating an elongate rotary tool that presents a sharp cutting edge, an apparatus for treating an elongate rotary tool that presents a sharp cutting edge, and an elongate rotary tool with a cutting edge treated according to the method of the invention.

More specifically, the invention concerns a method of honing a hard cemented carbide elongate rotary tool (such as a drill) that presents a sharp cutting edge, an apparatus for honing a hard cemented carbide elongate rotary tool (such as a drill) that presents a sharp cutting edge, and a hard cemented carbide elongate rotary tool (such as a drill) with a cutting edge honed according to the method of the invention.

Heretofore in the manufacture of an elongate rotary tool which presents a sharp cutting edge, e.g., a drill, endmill, hob, or reamer, made from a cemented carbide, e.g., tungsten carbide cemented with cobalt, one had to impinge the as-ground surfaces and hone the sharp cutting edge with a brush. The typical brush uses a nylon filament impregnated with a 120 grit (average particle diameter of about 142 micrometers (μm)) silicon carbide particulates wherein the composition of the filament is about 30 weight percent silicon carbide. The brush rotates at a speed of about 750 rpm and impinges the selected surfaces and sharp cutting edges for about 15 seconds. There are, however, a number of drawbacks to using the brush process to impinge the as-ground surfaces and hone the sharp cutting edge (or edges) of an elongate rotary tool.

One drawback with the brush process itself is the number of steps that are necessary to brush the elongate rotary tool. Only through physical manipulation does the brush impinge upon the various surfaces including certain edges of the elongate rotary tool. In the case of a drill, the brush has to impinge the axially forward cutting edges, the side cutting edges, the axially forward as-ground surfaces, and possibly the edges of the flutes. These edges and surfaces are at different orientations so that at least several steps are necessary to complete the honing operation. The necessity of using several processing steps adds to the cost of, and decreases the efficiencies associated with, the brush process. In view of this drawback, it would be desirable to provide a method for honing an elongate rotary tool that presents a sharp cutting edge wherein the method comprises a minimum number of steps so as to decrease the cost and increase the efficiencies associated with the process.

Another drawback with the brush process is that the elongate rotary tool does not present an axially forward cutting edge that has a consistent edge preparation, i.e., edge condition, across the face of the elongate rotary tool. For example, in the case of a drill with diametrically opposed axially forward cutting edges treated with the brush process, these cutting edges do not have a consistent edge preparation. More specifically, the surface roughness as well as the presence of broken or chipped edges is not consistent between each cutting edge. When an elongate rotary tool such as a drill has axially forward cutting edges that are inconsistent, the drill has the tendency to wobble about its longitudinal axis during the cutting, i.e., drilling, operation. The existence of this wobble during drilling results in the holes (or bores) becoming eccentric or oval in shape or cross-section so as to lose their circularity.

Another drawback with the brush process is that while the edge preparation for an elongate rotary tool may have been within the specification, it still presents a certain degree of inconsistency along the entire length of the cutting edge. For example, one length of the cutting edge may experience maximum deviation from the nominal parameter in one direction and another length of the cutting edge may experience maximum deviation from the nominal parameter in the other direction. Although each location along the cutting edge is within the specified parameter, the extent of this variation from the nominal parameter along the entire length of the cutting edge results in less than optimum performance of the elongate rotary tool such as, for example, the wobbling of the drill during the cutting operation.

Another drawback with an elongate rotary tool, e.g., a drill, treated according to the brush process occurs in precision drilling applications. In this type of application, while the resultant holes or bores essentially maintain their roundness, they still experience some deviation from the nominal diameter due to deviations from the nominal parameter in the drill. In a precision drilling application, any deviation from the nominal diameter is an undesirable feature since the hole or bore may lose its circularity.

The above drawbacks regarding the inconsistency of the edge preparation or extent of deviation from the nominal parameter for the cutting edge by the brush process demonstrate that improvements over the brush process are desirable. It would be desirable to provide a method for honing an elongate rotary tool, as well as an apparatus for carrying out the method and the resultant elongate rotary tool, wherein the elongate rotary tool presents a honed cutting edge that has a consistent edge preparation, especially in the case of an axially forward cutting edge that spans the face of the elongate rotary tool. It would also be desirable to provide a method of cutting that uses the resultant elongate rotary tool so as to produce a hole or bore with satisfactory circularity, especially with respect to precision cutting applications.

Still another drawback with the brush process is that after honing an elongate rotary tool such as a drill, the intersection between the surface (or side edge) defining the outside diameter of the drill and the axially forward cutting edge of the drill is honed to an excessive extent. Oftentimes, the extent of honing is so great so as to "over hone" this intersection. By exceeding the specification for the size (or extent) of the hone at this intersection the cutting edge is rounded, i.e., it loses its sharpness. The consequence of the rounded cutting edges (i.e., loss of a sharp edge at the juncture of this surface and the axially forward cutting edge) is that the drill does not have optimum cutting ability so that additional pressure, i.e., force, was needed to drill using an "overhoned" drill. The use of additional force has the tendency to shorten the useful life of the drill.

Another drawback with the brush process is the excessive rounding of the forward (or nose) cutting edge of an elongate rotary tool such as a drill. The presence of excessive rounding of the forward cutting edge results in a reduction of the cutting ability of the drill. Like for the overhoned condition, the additional pressure necessary to adequately operate a drill with a rounded forward cutting edge has the tendency to shorten the useful life of the drill.

The drawbacks regarding the overhoning of the elongate rotary tool and the rounding of the forward cutting edge shows that it would be desirable to provide a method for honing an elongate rotary tool, as well as an apparatus for carrying out the method and the resultant elongate rotary tool, in which the elongate rotary tool is not overhoned and the forward cutting edge is not excessively rounded during the honing process.

Another drawback with the brush process is the inability to remove grinding marks from the as-ground surfaces (or faces) of the elongate rotary tool. These grinding marks result from the initial grinding operation that forms the axially forward surfaces and the cutting edges. The brush process does not eliminate these grinding marks, but instead, leaves many of the grinding marks in the surface of the elongate rotary tool. Each grinding mark represents a stress riser. Each stress riser increases the potential for the elongate rotary tool to have a shortened useful life due to chipping. This drawback reveals that it would be desirable to provide a method for honing an elongate rotary tool, as well as an apparatus for carrying out the method and the resultant elongate rotary tool, that significantly reduces (if not essentially eliminates) stress risers in the form of grinding marks in the as-ground surfaces of the elongate rotary tool. The significant reduction, or even the elimination, of the grinding marks increases the potential that the elongate rotary tool will have a longer useful life.

Earlier patent documents disclose various methods and structures by which an abrasive impinges the surface of a workpiece. However, none of these patent documents discuss a method or apparatus for treating or honing an elongate rotary tool that presents a sharp cutting edge such as, for example, a drill, endmill, hob or reamer. Thus, while these patent documents address this technology in a general way, they do not present any solutions to the above drawbacks. A brief description of these patent documents now follows.

Referring now to the patent documents, U.K. Patent No. 1,184,052 to Ashworth et. al. presents a method by which one can eliminate tin plating of alloy pistons that were cast and then machined prior to plating. The method provides for the wet blasting of the machined pistons with an abrasive. The surface produced by the wet blast of abrasive resists scuffing and improves the lubricating properties of the abraded surface.

U.S. Pat. No. 5,341,602 to Foley addresses a slurry polishing method for removing metal stock from a complex part such as a turbine blade. The '602 Patent presents a structure which deflects the high pressure slurry over the surface of the turbine blade so as to consistently remove metal stock thereby reducing the need for hand blending and additional slurry polishing to correct for inconsistent metal removal.

U.S. Pat. No. 4,280,302 to Ohno concerns a structure for using hone grains to grind a workpiece. The structure permits the workpiece to be rotated, as well as moved upwardly and downwardly, to achieve the necessary grinding of the workpiece.

U.K. Patent No. 1,236,205 to Field pertains to a method of slurry abrading the surface of a bore in a tube. A slurry of abrasive and liquid is propelled along the bore of the tube by compressed gas thereby impinging the surface of the bore of the tube. The result is a bore surface that has a finish within a specified range.

U.K. Patent No. 1,266,140 to Ashworth mentions the use of a slurry of abrasive to treat the surface of a workpiece. More specifically, this patent provides for placing an enclosure around the workpiece, applying suction to the enclosure so as to induce a flow of primary air into the enclosure, entraining a slurry of abrasive and liquid in the primary air flow, directing the abrasive-liquid slurry against the surface of the workpiece, and removing the slurry. This process is supposed to provide for a more gentle abrading process than a dry abrasion.

U.S. Pat. No. 2,497,021 to Sterns shows a structure for grinding or honing using a spray slurry. The structure uses a cylindrical member with helical passages to regulate the flow of the abrasive slurry to the workpiece.

U.S. Pat. No. 3,039,234 to Balman shows a structure that is used to hone the interior surface of a passage by reciprocating the abrasive fluid through the passage.

U.S. Pat. No. 3,802,128 to Minear et. al. concerns a structure that removes metal from a workpiece by extruding through it abrasive particles. The abrasive particles are in mechanical contact with the workpiece so as to remove metal therefrom.

U.S. Pat. No. 4,687,142 to Sasao et al. shows a structure to hone the interior passages of a fuel discharge port by directing an abrasive fluid against the surface. The abrasive fluid also smooths the valve seat and rounds the intersection of the discharge port and the valve seat.

U.S. Pat. No. 4,203,257 to Jamison et al. shows a method of drilling holes in printed circuit boards and then cleaning the hole with an abrasive slurry.

While the brush process produced hard members with overall adequate performance, the above description of the drawbacks with the brush process, and the lack of any patent documents that address these drawbacks, reveals that there is room for improvement in the treating or honing of hard members with sharp cutting edges.

SUMMARY

It is an object of the invention to provide an improved method of honing an elongate rotary tool that presents a sharp cutting edge wherein the method comprises a minimum number of steps.

It is another object of the invention to provide an improved method of honing an elongate rotary tool that presents a sharp cutting edge, as well as an apparatus for carrying out the method and the resultant elongate rotary tool, wherein the elongate rotary tool presents a honed cutting edge that has a consistent edge preparation.

It is an object of the invention to provide an improved method of honing an elongate rotary tool that presents a sharp cutting edge, as well as the elongate rotary tool, wherein the juncture of the forward cutting edge and the side cutting edge is not overhoned, but is sharp.

Finally, it is another object of the invention to provide an improved method for honing an elongate rotary tool that presents a sharp cutting edge, as well as an apparatus for carrying out the method and the elongate rotary tool, wherein the face of the elongate rotary tool does not have grinding marks which function as stress risers.

In one form thereof, the invention is a method of treating an elongate rotary tool that presents a sharp cutting edge. The method comprises the steps of: emitting under pressure from a nozzle assembly an abrasive fluid stream comprising an abrasive grit entrained in a fluid; and impinging the abrasive fluid stream against the sharp cutting edge of the elongate rotary tool for a preselected time so as to transform the sharp cutting edge into a relatively uniformly honed edge.

In another form thereof, the invention is an apparatus for treating an elongate rotary tool that presents a sharp cutting edge. The apparatus comprises a fixture that releasably holds the elongate rotary tool, and a nozzle assembly that is in communication with a source of an abrasive slurry so as to be able to emit under pressure an abrasive steam. The nozzle assembly and the elongate rotary tool are moveable relative to each other so that during the emission of the abrasive stream the abrasive stream impinges the entire length of the sharp cutting edge so as to transform the sharp cutting edge into a relatively uniformly honed cutting edge.

In still another form thereof, the invention is an elongate rotary tool that has a relatively uniformly honed cutting edge produced by the process comprising the steps of: emitting under pressure from a nozzle assembly an abrasive fluid stream comprising an abrasive grit entrained in a fluid; and impinging the abrasive fluid stream against a sharp cutting edge of the elongate rotary tool for a preselected time so as to transform the sharp cutting edge into a relatively uniformly honed cutting edge.

BRIEF DESCRIPTION OF THE DRAWINGS

The following is a brief description of the drawings that form a part of this patent application.

DETAILED DESCRIPTION OF PREFERRED EMBODIMENTS

Figure 1:
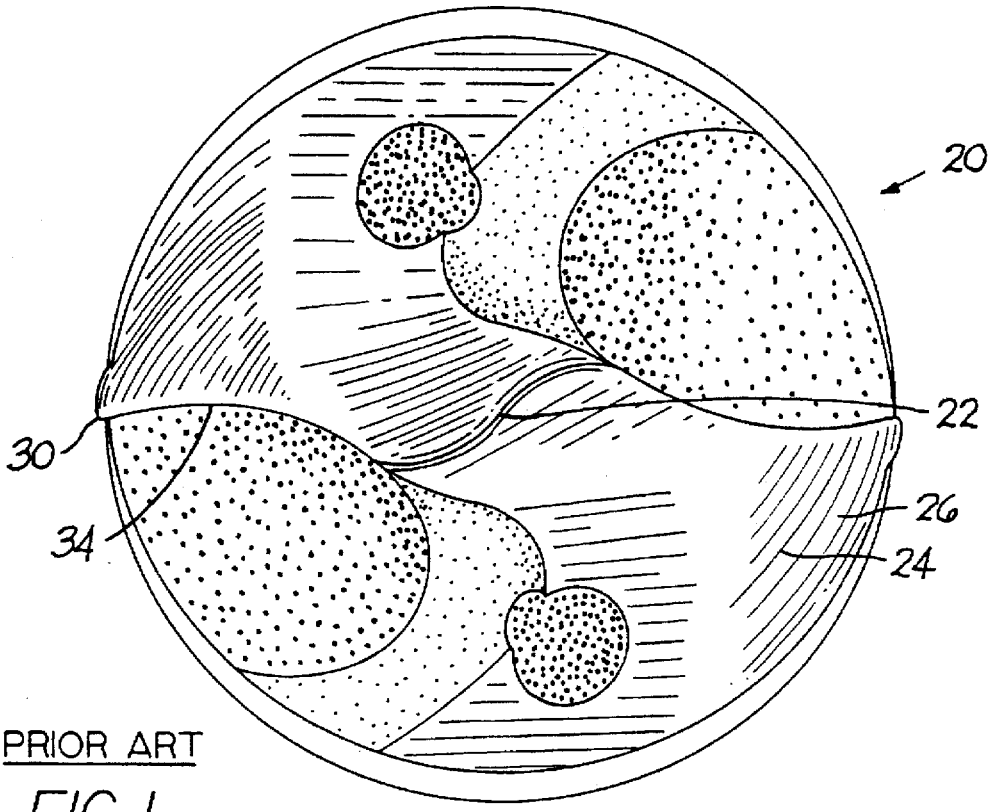
PRIOR ART FIG. 1
FIG. 1 is a top view of a prior art drill treated according to the prior art method of brush honing.
Figure 2:
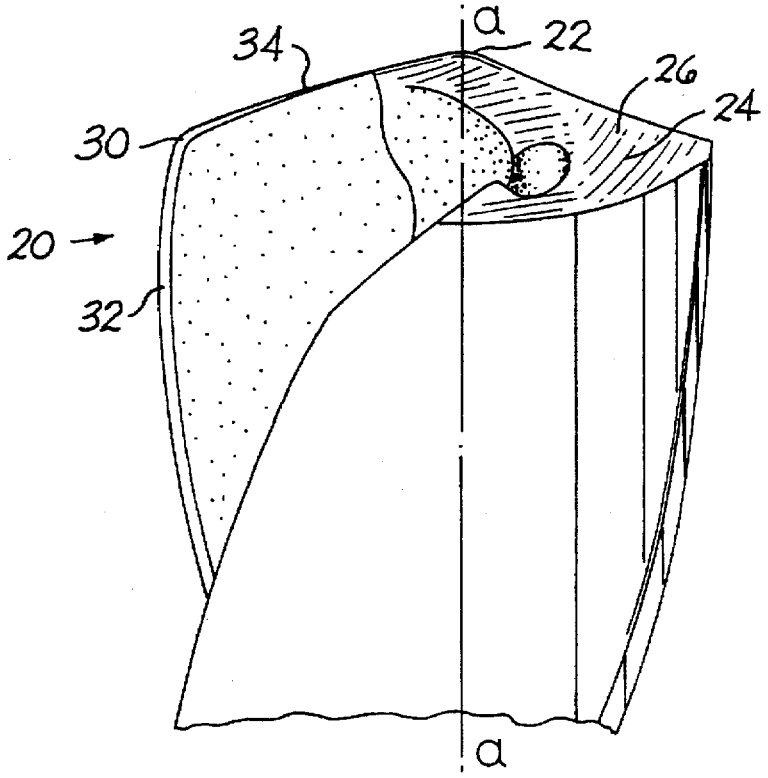
PRIOR ART FIG. 2
FIG. 2 is a side view of a prior art drill treated according to the prior art method of brush honing.

In order to appreciate the meaningful advantages which this invention provides, applicant sets forth FIGS. 1 and 2 which illustrate the structure of a drill (tungsten carbide cemented with cobalt) honed according to the typical prior art method, i.e., brush honing. Applicant also includes FIG. 6 through FIG. 9 which are photographs of a tungsten carbide drill that was honed according to the brush process. As a consequence, FIGS. 1, 2 and 6 through 9 are identified as being "PRIOR ART".

Referring to the nature of these drills, the drawings and photographs illustrate a two-fluted style of drill that has coolant channels. The typical types of materials that this two-fluted coolant channel style of drill cuts includes carbon, alloy and cast steel, high alloy steel, malleable cast iron, gray cast iron, nodular iron, yellow brass and copper alloys.

It should be appreciated that other styles of elongate rotary tools are within the scope of the invention and include without limitation endmills, hobs, and reamers. It should also be appreciated that various styles of drills are within the scope of this invention. In this regard, other styles of drills include without limitation a triple fluted style of drill and a two-fluted style of drill that does not have coolant channels. The triple fluted style of drill typically cuts gray cast iron, nodular iron, titanium and its alloys, copper alloys, magnesium alloys, wrought aluminum alloys, aluminum alloys with greater than 10 weight percent silicon, and aluminum alloys with less than 10 weight percent silicon. The two-fluted without coolant channels style of drill typically cuts carbon steel, alloy and cast steel, high alloy steel, malleable cast iron, gray cast iron, nodular iron, yellow brass and copper alloys. In addition to the metallic materials mentioned above, the drills, end mills, hobs, and reamers may be used to cut other metallic materials, polymeric materials, and ceramic materials including without limitation combinations thereof (e.g., laminates, macrocomposites and the like), and composites thereof such as, for example, metal-matrix composites, polymer-matrix composites, and ceramic-matrix composites.

A typical material for the substrate 10 is tungsten carbide cemented with cobalt. Other typical materials include tungsten carbide-based material with other carbides (e.g. TaC, NbC, TiC, VC) present as simple carbides or in solid solution. The amount of cobalt can range between about 0.2 weight percent and about 20 weight percent, although the more typical range is between about 5 weight percent and about 16 weight percent. Typical tungsten carbide-cobalt (or tungsten carbide-based/cobalt) compositions used for a drill or other hard member (e.g., a reamer) include the following compositions and their properties.

Composition No. 1 comprises about 11.5 weight percent cobalt and the balance tungsten carbide. For Composition No. 1, the average grain size of the tungsten carbide is about 1–4 micrometers (μm), the density is about 12,790±100 kilograms per cubic meter (kg/m$^3$), the Vickers hardness is about 1350±50 HV30, the magnetic saturation is about 86.5 percent (±7.3 percent) wherein 100 percent is equal to about 202 microtesla cubic meter per kilogram-cobalt ($\mu Tm^3/kg$) (about 160 gauss cubic centimeter per gram-cobalt (gauss-$cm^3/gm$)), the coercive force is about 140±30 oersteds, and the transverse rupture strength is about 2.25 gigapascal (GPa).

Composition No. 2 comprises about 11.0 weight percent cobalt, 8.0 weight percent Ta(Nb)C, 4.0 weight percent TiC and the balance tungsten carbide. For Composition No. 2, the average grain size of the tungsten carbide is about 1–8 μm, the density is about 13,050±100 $kg/m^3$, the Vickers hardness is about 1380 ±50 HV30, the magnetic saturation is about 86.4 percent (±7.2 percent), the coercive force is about 170±15 oersteds, and the transverse rupture strength is about 2.5 GPa.

Composition No. 3 comprises about 6.0 weight percent cobalt, 1.6 weight percent Ta(Nb)C, and the balance tungsten carbide. For Composition No. 3, the average grain size of the tungsten carbide is about 1 μm, the density is about 14,850±50 $kg/m^3$, the Vickers hardness is about 1690±50 HV30, the magnetic saturation is about 86.6 percent (±7.4 percent), the coercive force is about 240±30 oersteds, and the transverse rupture strength is about 2.6 GPa.

Composition No. 4 comprises about 9.5 weight percent cobalt and the balance tungsten carbide. For Composition No. 4, the average grain size of the tungsten carbide is about 0.8 μm, the density is about 14,550±50 $kg/m^3$, the Vickers hardness is about 1550±30 HV30, the magnetic saturation is about 86.5 percent (±7.3 percent), the coercive force is about 245±20 oersteds, and the transverse rupture strength is about 3.6 GPa.

Composition No. 5 comprises about 8.5 weight percent cobalt and the balance tungsten carbide. For Composition No. 5, the average grain size of the tungsten carbide is about 2.5 μm, the density is about 14,700±100 $kg/m^3$, the Vickers hardness is about 1400 ±30 HV30, the magnetic saturation is about 86.8 percent (±7.6 percent), the coercive force is about 150±20 oersteds, and the transverse rupture strength is about 3.0 GPa.

Composition No. 6 comprises about 9.0±0.4 weight percent cobalt, about 0.3 to 0.5 weight percent tantalum and no greater than about 0.2 weight percent niobium in the form of Ta(Nb)C, no greater than about 0.4 titanium in the form of TiC and the balance tungsten carbide. For Composition No. 6, the average grain size of the tungsten carbide is about 1–10 μm, the density is about 14,450±150 $kg/m^3$, the Rockwell A hardness is about 89.5±0.6, the magnetic saturation is about 93 percent (±5 percent), the coercive force is about 130±30 oersteds, and the transverse rupture strength is about 2.4 GPa.

Composition No. 7 comprises about 10.3±0.3 weight percent cobalt, about 5.2±0.5 weight percent tantalum and about 3.4±0.4 weight percent niobium in the form of Ta(Nb)C, about 3.4±0.4 weight percent titanium in the form of TiC and the balance tungsten carbide. For Composition No. 7, the average grain size of the tungsten carbide is about 1–6 μm, the porosity is A06, B00, C00 (per the ASTM Designation B 276–86 entitled "Standard Test Method for Apparent Porosity in Cemented Carbides"), the density is about 12,900±200 $kg/m^3$, the Rockwell A hardness is about 91±0.3 HV30, the magnetic saturation is between about 80 percent and about 100 percent, the coercive force is about 160±20 oersteds, and the transverse rupture strength is about 2.4 GPa.

Composition No. 8 comprises about 11.5±0.5 weight percent cobalt, about 1.9±0.7 weight percent tantalum and about 0.4±0.2 weight percent niobium in the form of Ta(Nb)C, no greater than about 0.4 titanium in the form of TiC and the balance tungsten carbide. For Composition No. 8, the average grain size of the tungsten carbide is about 1–6 μm, the porosity is about A06, B00, C00 (per ASTM Designation B 276–86), the density is about 14,200±200 $kg/m^3$, the Rockwell A hardness is about 89.8±0.4, the magnetic saturation is about 93 percent (±5 percent), the coercive force is about 160±25 oersteds, and the transverse rupture strength is about 2.8 GPa.

Composition No. 9 comprises about 10.0±0.3 weight percent cobalt, no greater than about 0.1 weight percent tantalum and about 0.1 weight percent niobium in the form of Ta(Nb)C, no greater than about 0.1 titanium in the form of TiC, about 0.2±0.1 weight percent vanadium in the form of vanadium carbide and the balance tungsten carbide. For Composition No. 9, the average grain size of the tungsten carbide is less than about 1 μm, the porosity is about A06, B01, C00 (per ASTM Designation B 276–86), the density is about 14,500±100 $kg/m^3$, the Rockwell A hardness is about 92.2±0.7, the magnetic saturation is about 89 percent (±9 percent), the coercive force is about 300±50 oersteds, and the transverse rupture strength is about 3.1 GPa.

Composition No. 10 comprises about 15.0±0.3 weight percent cobalt, no greater than about 0.1 weight percent tantalum and about 0.1 weight percent niobium in the form of Ta(Nb)C, no greater than about 0.1 titanium in the form of TiC, about 0.3 ±0.1 weight percent vanadium in the form of vanadium carbide and the balance tungsten carbide. For Composition No. 10, the average grain size of the tungsten carbide is less than about 1 μm, the porosity is A06, B01, C00 (per ASTM Designation B 276–86), the density is about 13,900 ±100 $kg/m^3$, the Rockwell A hardness is about 91.4±0.4, the magnetic saturation is about 84 percent (±4 percent), the coercive force is about 300±20 oersteds, and the transverse rupture strength is about 3.5 GPa.

It should be appreciated that other binder materials may be appropriate for use. In addition to cobalt and cobalt alloys, suitable metallic binders include nickel, nickel alloys, iron, iron alloys, and any combination of the above materials (i.e., cobalt, cobalt alloys, nickel, nickel alloys, iron, and/or iron alloys).

In brush honing, a rotating multi-filament brush impinges selected surfaces of the drill including the as-ground axially forward surface. The as ground axially forward surface contains grinding marks, and as will become apparent, the brush process does not remove all of the grinding marks. The brush also impinges the sharp cutting edges of the drill so as to hone the sharp cutting edges thereof. The cemented tungsten carbide drills of FIGS. 1,2 and 6–9 were treated in the following way. The filaments were silicon carbide-impregnated Nylon with a silicon carbide content of about 30 weight percent. The silicon carbide was in the form of about 120 grit (average particle diameter of about 142 μm) silicon carbide particulates. The speed of rotation was about 750 rpm and the duration of impingement was about 15 seconds.

Referring to FIGS. 1 and 2, as well as FIGS. 6 through 9, these drawings and photographs illustrate the structure of a two-fluted drill (with coolant passages), generally designated as 20, which has been honed according to the brush process of the prior art. As is apparent from FIG. 1, the S-shaped nose 22 of the drill 20 has been rounded by the prior art process. In this regard, FIG. 6 also shows this rounding of the S-shaped nose.

Figure 9:
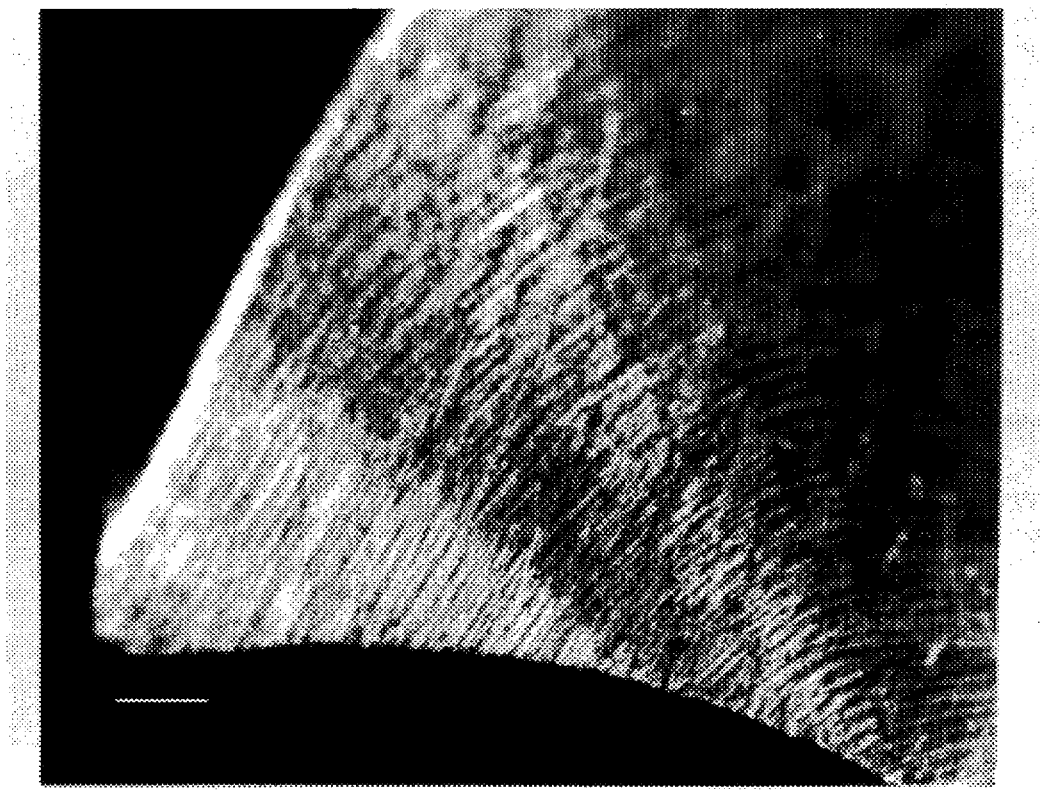
FIG. 9 is a photograph (the white scale marker in the lower left-hand corner of the photograph equals about 0.28 mm thus the magnification is about 46×) from the top of the axially forward end of the cemented tungsten carbide drill of FIG. 6.

In addition, there are grinding marks 24 in the forward arcuate surface 26 of the drill 20. These grinding marks were the result of the process involved with forming the point by the grinding machine. More specifically, the grinding marks were produced by the diamond wheel that was used to accurately grind the drill nose form. The brush process did not remove all of the grinding marks so that grinding marks remain. These grinding marks 24 extend across the entire length of the forward arcuate surface 26. FIG. 9 shows the presence of these grinding marks with excellent clarity. As is apparent from the drawings and photographs, there are many grinding marks in the face of the prior art drill. Each grinding mark constitutes a stress riser which increases the potential to shorten the useful life of the drill because of chipping.

Figure 2A:
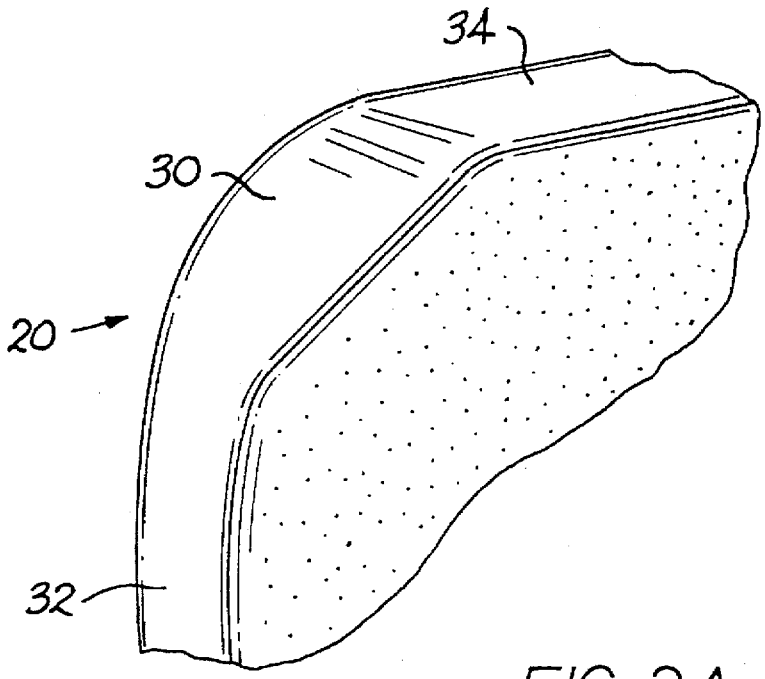
FIG. 2A is an enlarged view of the juncture of the axially forward cutting edge and the side edge of the specific embodiment shown in FIG.2 hereof.

As is apparent from FIGS. 2 and 2A, the intersection (or juncture) 30 of the surface 32 that defines the outside diameter of the drill 20 and the nose cutting edge 34, which has an angular orientation relative to the longitudinal axis a—a of the drill 20, is overhoned. The presence of the overhoned condition is also shown with excellent clarity in FIGS. 7 and 8. In other words, the brush process removed more material than was specified from this intersection 30, i.e., the intersection was overhoned. The result is that greater force or pressure is needed to operate the drill so that it cuts in an adequate fashion. The use of such greater force typically shortens the useful life of the drill.

Figure 3:
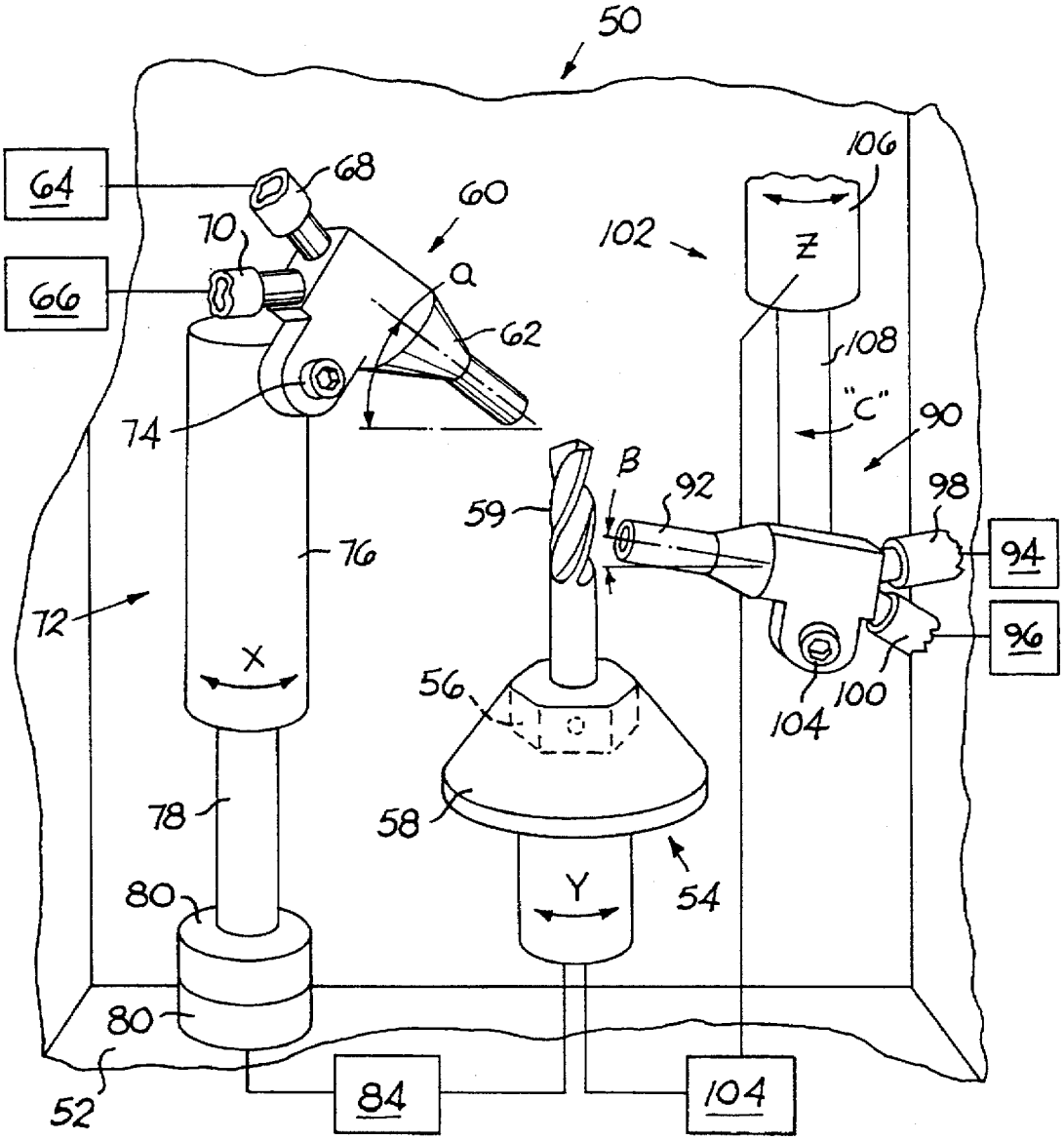
FIG. 3 is a schematic-perspective view of a specific embodiment of an apparatus for honing the sharp edge of a hard member with a portion of the enclosure removed to reveal the components of the apparatus.

Referring to the drawing of the specific embodiment of the apparatus of the invention (FIG. 3), this drawing presents a view (partially in perspective and partially in schematic) of one specific embodiment of the apparatus for treating (or honing) the drill (hard member) that presents a sharp cutting edge with an abrasive fluid stream. The specific honing apparatus is generally designated as 50. Honing apparatus 50 includes an enclosure 52, which FIG. 3 illustrates a portion thereof. The enclosure 52 contains the components, i.e., the grit and the fluid (e.g., water), of the abrasive fluid stream throughout the honing process.

The honing apparatus 50 further includes a chuck assembly generally designated as 54. Chuck assembly 54 includes a base member 58 which is capable of rotation (see arrow Y). Chuck assembly 54 further includes a holder 56 which holds the hard member 59 (drill) via a set screw. A receiving opening in the forward end of the base member 58 receives the holder 56 along with the drill 59 secured thereto. While the holder 56 and the receiving opening are hexagonal in shape, it should be appreciated that other geometries or shapes would be suitable for use herein.

Honing apparatus 50 further includes a first spray nozzle assembly generally designated as 60 which includes a nozzle 62, a source of abrasive slurry 64 (illustrated in schematic) and a source of pressurized air 66 (illustrated in schematic). A hose 68 (shown partially in perspective and partially in schematic) places the source of abrasive slurry 64 in communication with the nozzle 62. Another hose 70 (shown partially in perspective and partially in schematic) places the source of pressurized air 66 in communication with the nozzle 62. The source of abrasive slurry 64 and the source of pressurized air 66 are external of the enclosure 52. Although the specific embodiment presents a nozzle, it should be appreciated that any structure that would emit a directional stream of abrasive slurry would be within the scope of this aspect of the invention.

The nozzle 62 mounts to a piston-cylinder arrangement generally designated as 72. The nozzle 62 is angularly adjustable via a set screw 74 so that the angular position of the nozzle 62 is adjustable. One can loosen the set screw 74 to set the attack angle of the nozzle, and then tighten the set screw 74 to secure the nozzle 62 in position. In other words, the angle of attack"" with respect to the horizontal of the abrasive fluid stream emitted from the bore of the nozzle 62 is adjustable with respect to the drill 59. The typical attack angle is about 45 degrees with respect to the horizontal.

The piston-cylinder arrangement 72 includes a cylinder 76 and a piston rod 78. One or spacers 80 may be positioned near the bottom of the piston rod 78 so as to select the vertical location of the nozzle 62 relative to the drill. The cylinder 76 is rotatable about its longitudinal axis (see arrow X), as well as movable along its longitudinal axis, so as to be able to selectively position the nozzle 62 prior to or during the honing operation. Along these lines, while the specific embodiment shows a piston cylinder arrangement, it should be appreciated that other devices may perform the same basic functions. In this regard, theses functions are to move the nozzle along a vertical axis and to rotate the nozzle about this vertical axis, as well as, to vary the angular orientation of the nozzle with respect to the vertical axis.

A first microprocessor 84 receives signals from the chuck assembly 54 and the first nozzle assembly 60 so as to control the relative movement of the nozzle 62 and the drill 59. FIG. 3 illustrates in schematic the connection between the chuck assembly 54 and the first nozzle assembly 60. Applicant contemplates that other arrangements to synchronize the movement of the nozzle (via the piston cylinder arrangement) and the movement of the drill (via the chuck) would be suitable. A mechanical coupling between the chuck and the piston-cylinder arrangement or the synchronization of members that function independently are suitable for, and are contemplated to within the scope of, the present invention.

Honing apparatus 50 further includes a second spray nozzle assembly generally designated as 90 which includes a nozzle 92, a source of abrasive slurry 94 (illustrated in schematic) and a source of pressurized air 96 (illustrated in schematic). A hose 98 (shown partially in perspective and partially in schematic) places the source of abrasive slurry 94 in communication with the nozzle 92. Another hose 100 (shown partially in perspective and partially in schematic) places the source of pressurized air 96 in communication with the nozzle 92. The source of abrasive slurry 94 and the source of pressurized air 96 are external of the enclosure 52.

The nozzle 92 mounts to a piston-cylinder arrangement generally designated as 102. The nozzle 92 is angularly adjustable via a set screw 104 so that the angular position of the nozzle 92 is adjustable like nozzle 62. In other words, the angle of attack with respect to the horizontal of the abrasive fluid stream emitted from the bore of the nozzle 92 is adjustable with respect to the drill 59. The typical attack angle is zero degrees with respect to horizontal.

The piston-cylinder arrangement 102 includes a cylinder 106 and a piston rod 108. The cylinder 106 is rotatable about its longitudinal axis (see arrow Z) so as to be able to rotate the nozzle 92 prior to or during the honing operation. The piston-cylinder arrangement 102 is functional so as to move the nozzle 92 in a direction along its longitudinal axis during the honing operation. While a microprocessor may control the function of the piston-cylinder arrangement 102, a pair of spaced-apart movable magnetic reed switches could also control the movement of the piston-cylinder arrangement 102, and hence, the nozzle 92.

A microprocessor 104 receives signals from the chuck assembly 54 and the second nozzle assembly 90 so as to control the relative movement of the nozzle 92 and the drill 59 treated according to the method of the invention. FIG. 3 illustrates in schematic the connection between the chuck assembly 54 and the second nozzle assembly 90.

It should be appreciated that other structure may be suitable for use in place of the nozzle 92, the piston-cylinder arrangement 102 and microprocessor 104 along the same lines as discussed above for the nozzle 62, the piston-cylinder arrangement 72 and the microprocessor 84. Furthermore, it should be appreciated that in the honing apparatus 50, the mounting of the nozzles (62 and 92) to the piston-cylinder assemblies (72 and 102, respectively) may be accomplished by any one of a variety of structures. The specific point of connection, whether on the cylinder or on the rod, is also subject to variation. Furthermore, the piston-cylinder assemblies 72, 102 may be connected to positioned within the volume of the enclosure in a variety of ways. Overall, it is apparent that the specific application for which the apparatus is used may dictate the type of mounting connection between the nozzle and the piston-cylinder assembly, as well as the position or orientation of the piston-cylinder assembly. This is also true for the position of the chuck assembly 54 in that the position of the chuck assembly 54 may vary depending upon the specific application.

It should also be appreciated that the moving parts inside the enclosure 52 may be protected from contamination by the abrasive grit. For example, a protective boot may enclose either or both piston rods (or both complete piston-cylinder arrangements) to protect it from contamination.

Figure 5A:
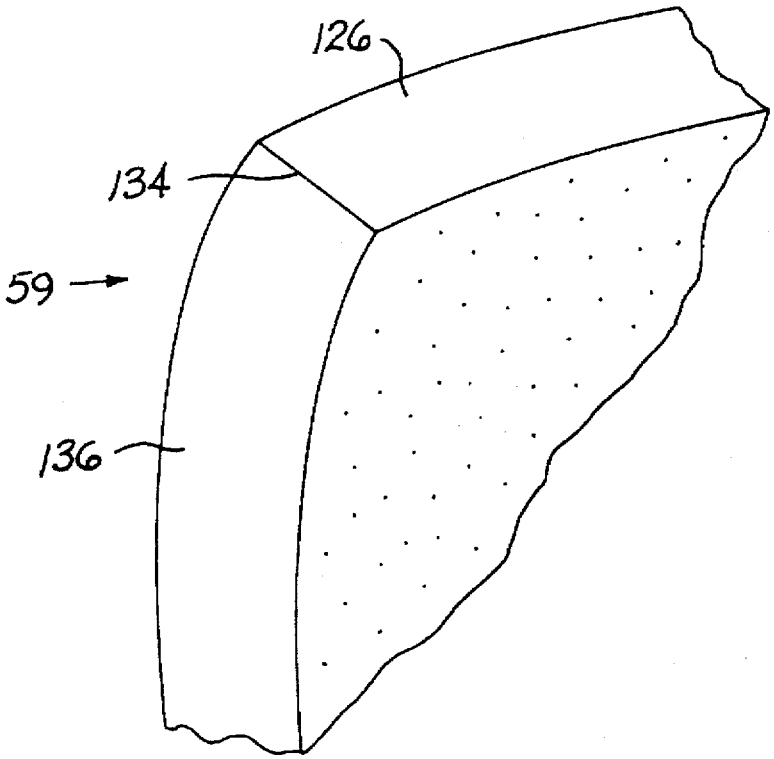
FIG. 5A is an enlarged view of the juncture of the axially forward cutting edge and the side edge of the specific embodiment shown in FIG.5.
Figure 4:
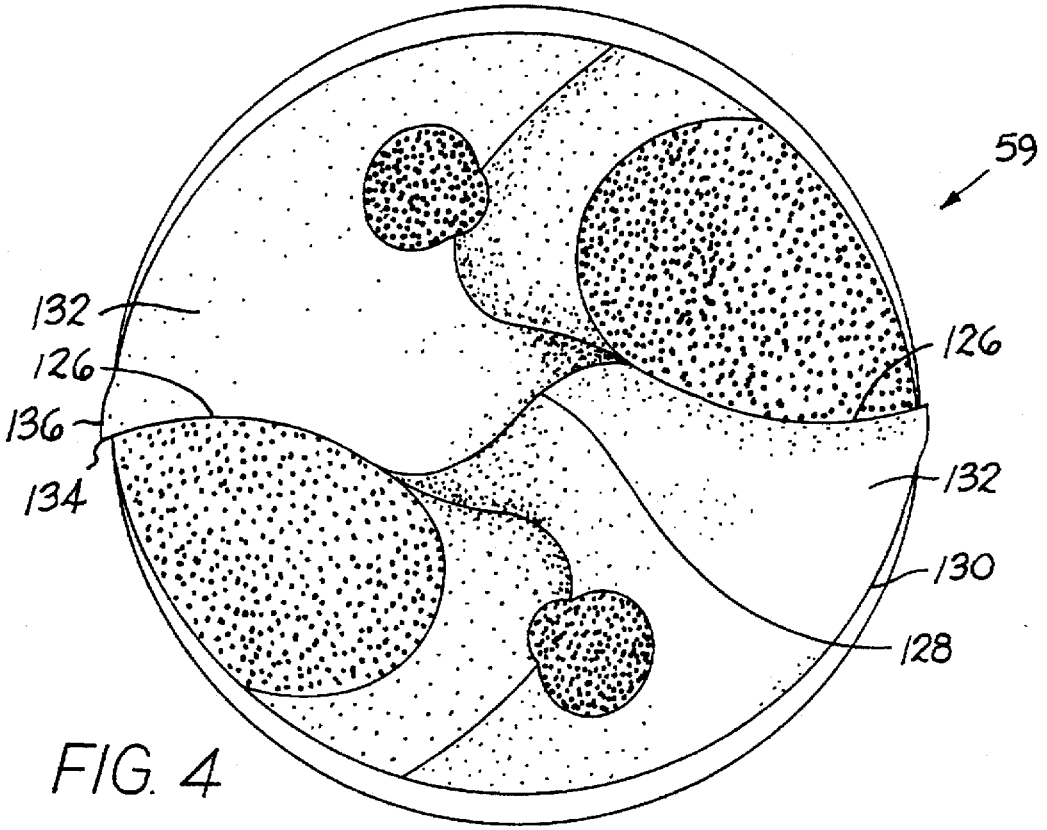
FIG. 4 is a top view of a specific embodiment of the invention treated according to the method of the invention.
Figure 5:
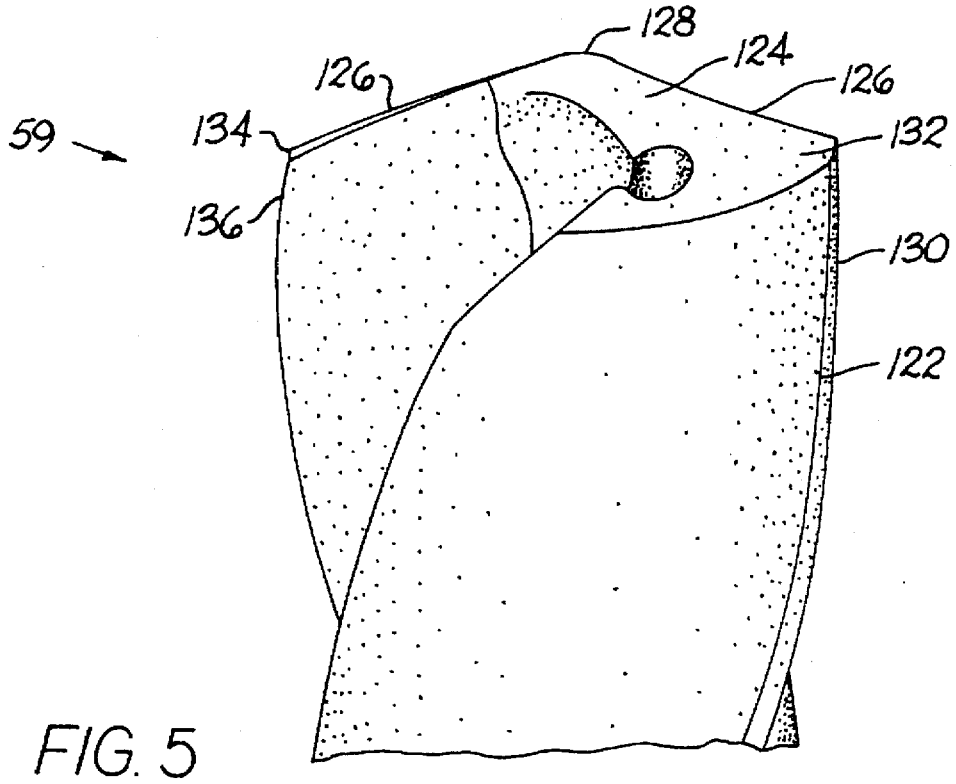
FIG. 5 is a side view of a specific embodiment of the invention treated according to the method of the invention.
Figure 6:
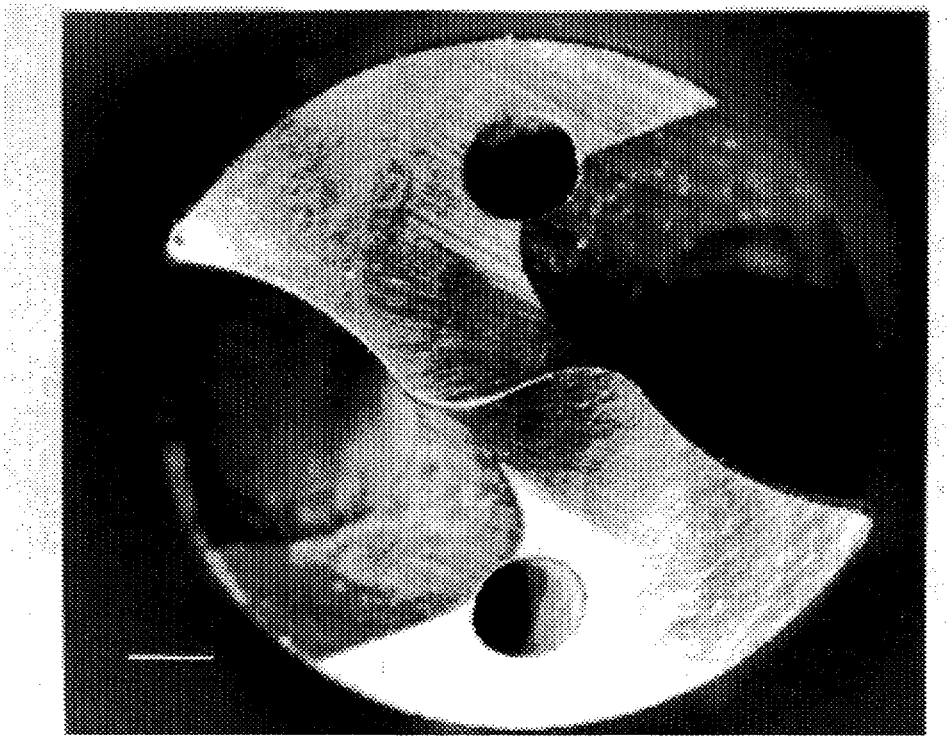
FIG. 6 is a photograph of the axially forward end of a cemented tungsten carbide (WC—Co) drill treated by the brush process (the white scale marker in the lower left-hand corner of the photograph equals about 1 millimeter (mm) thus the magnification is about 12×)
Figure 7:
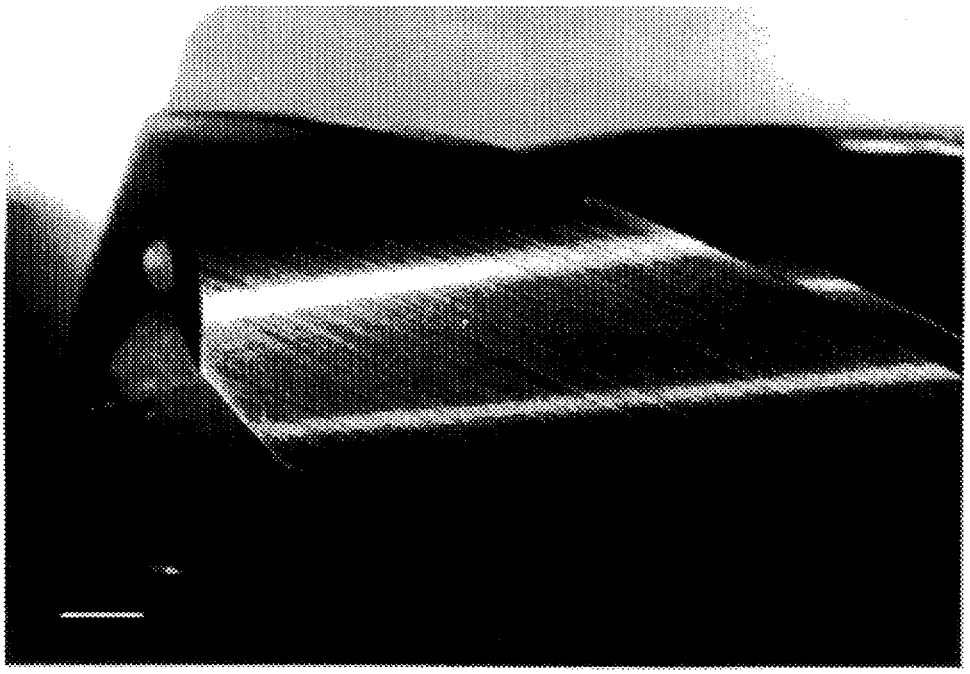
FIG. 7 is a photograph (the white scale marker in the lower left-hand corner of the photograph equals about 1.6 mm thus the magnification is about 7.5×) from the side of the axially forward end of the cemented tungsten carbide drill of FIG. 6.
Figure 8:
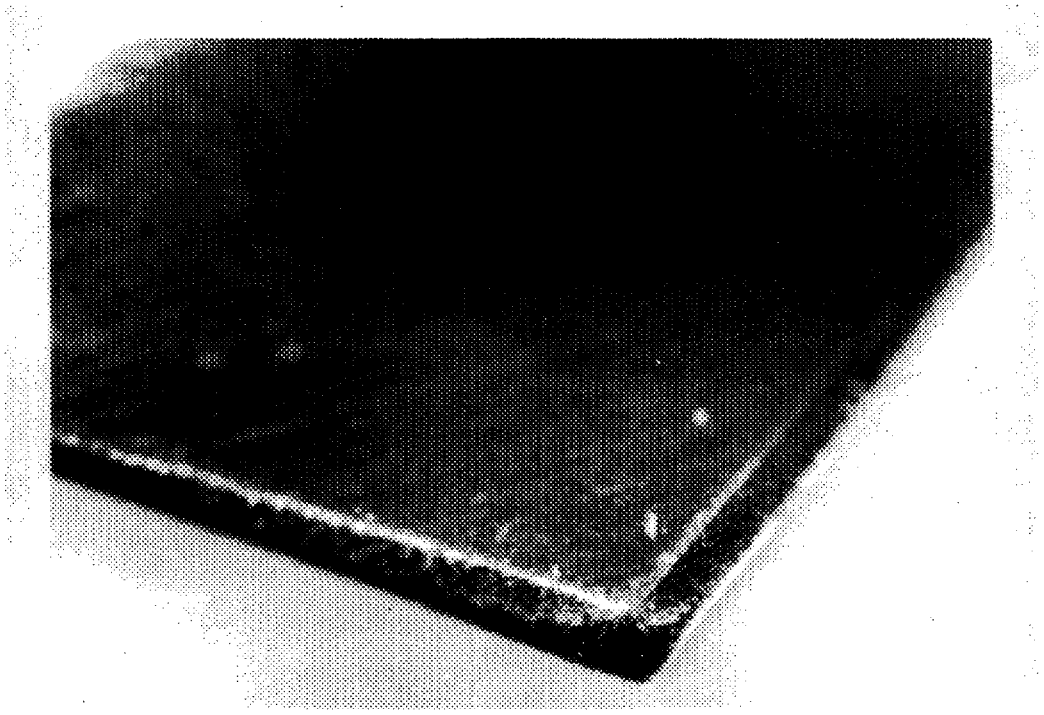
FIG. 8 is a photograph (the white scale marker in the lower left-hand corner of the photograph equals about 0.23 mm thus the magnification is about 56×) from the side of the axially forward end of the cemented tungsten carbide drill of FIG. 6.

Referring to FIGS. 4 and 5, these drawings illustrate the structure of a drill which has been treated, or honed, according to the method of the invention. In regard to the specific method, the operating parameters for the specific honing process are set forth as follows: the abrasive was about 320 grit (average particle size of about 32 μm) alumina particulates, the concentration was about 2.3 kilograms (kg) [5 pounds (lbs.)] of alumina particulates per 26.5 liters (1.) [7 gallons (gal.)] of water, the air pressure was about 275 kiloPascals (kPa) [about 40 pounds per square inch (psi)], and the duration of impingement was about 35 seconds.

It should be appreciated that these operating parameters, as well as the type of abrasive and fluid, can vary depending upon the specific application and the desired resultant edge preparation. In regard to the abrasive, it can include, in addition to alumina, silicon carbide, boron carbide, glass beads or any other abrasive particulate material. In addition to water, the fluid may include any liquid or gas compatible with the abrasive. In some cases, one may want to coat the abrasive with a wetting agent.

Drill 59 includes an elongate body 122 that has a forward (or nose) end 124. There are a pair of nose cutting edges 126 which depend from the apex of the drill 59. Near the apex of the drill 59 there is an S-shaped nose 128. The cutting edges 126 blend into a sharp continuous cutting edge 130 along the length of the drill 59. The sharp continuous cutting edge 130 takes the form of a helix and continues for a preselected distance along the length of the elongate body 122. Drill 59 further includes an arcuate forward surface 132. There is an intersection 134 between the surface 136 that defines the outside diameter of the drill 59 and the nose cutting edge 126.

Figure 10:
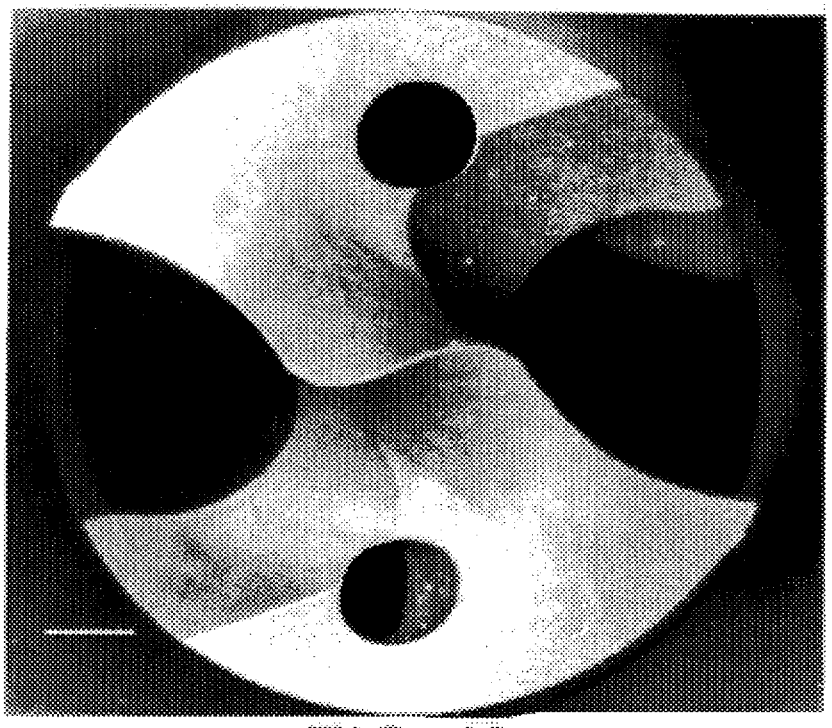
FIG. 10 is a photograph (the white scale marker in the lower left-hand corner of the photograph equals about 1.1 mm thus the magnification is about 12×) taken from the top of the axially forward end of a cemented tungsten carbide (WC—Co) drill treated by the process of the invention.

As is apparent from FIG. 4, the S-shaped nose of the drill has been slightly rounded by the process, but not nearly to the extent as is the typical case by the brush honing process. A comparison of FIG. 10 (the invention) with FIG. 6 (prior art) clearly shows that the S-shaped nose of the drill is much sharper in FIG. 10 than in FIG. 7. In this regard, the greater reflection of light in FIG. 6 at this point demonstrates that it is more rounded.

Figure 13:
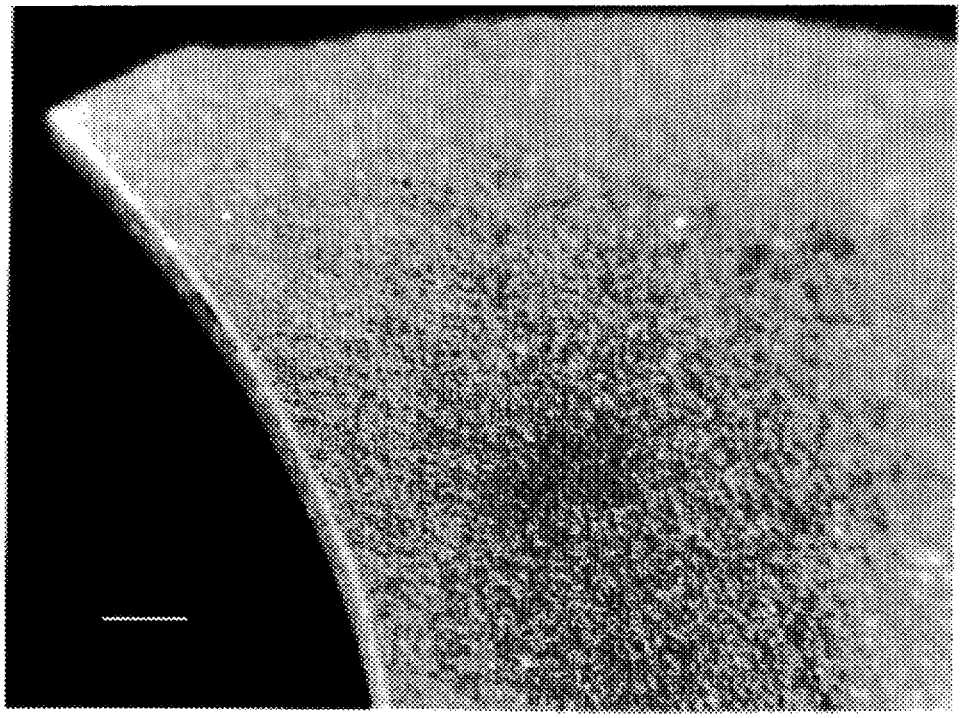
FIG. 13 is a photograph (the white scale marker in the lower left-hand corner of the photograph equals about 0.28 mm thus the magnification is about 43×) from the top of the axially forward end of the cemented tungsten carbide drill of FIG. 10.

The forward arcuate surface of the drill presents a relatively uniformly smooth surface, and does not contain grinding marks as is the case with the brush honing process of the prior art. The absence of grinding marks in the drill honed according to the invention is very apparent from a comparison of FIGS. 6 and 9 (prior art) with FIGS. 10 and 13, (the invention) respectively.

Figure 11:
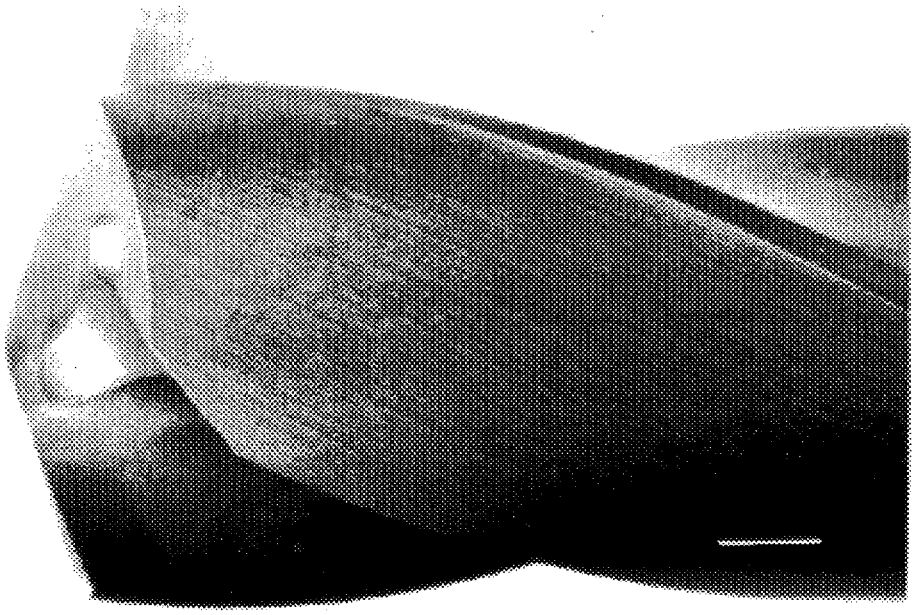
FIG. 11 is a photograph (the white scale marker in the lower right-hand corner of the photograph equals about 1.7 mm thus the magnification is about 9×) from the side of the axially forward end of the cemented tungsten carbide drill of FIG. 10.
Figure 12:
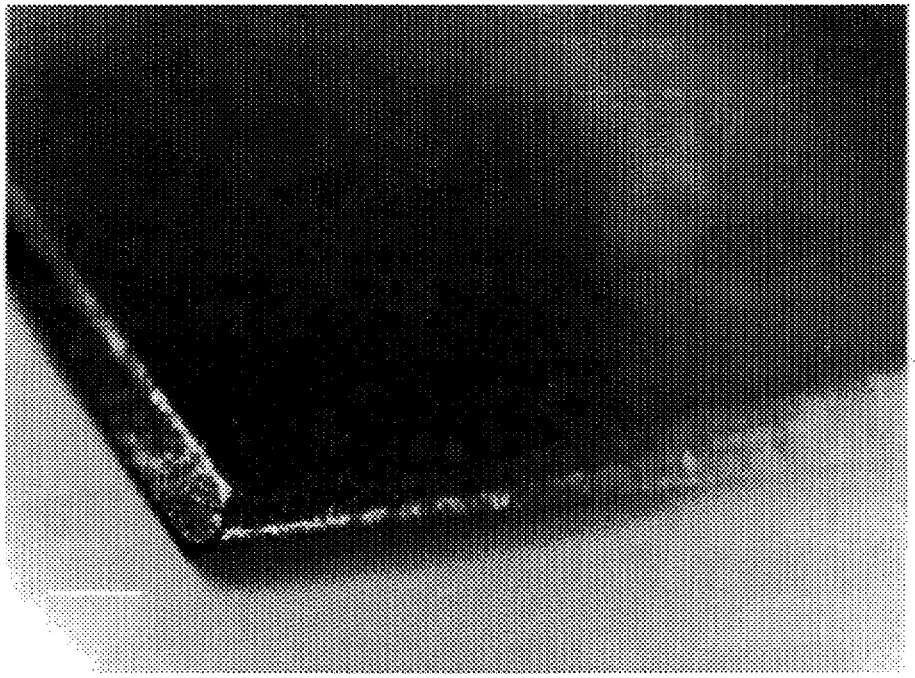
FIG. 12 is a photograph (the white scale marker in the lower left-hand corner of the photograph equals about 0.25 mm thus the magnification is about 54×) from the side of the axially forward end of the cemented tungsten carbide drill of FIG. 10.

As is apparent from FIGS. 5 and 5A, the intersection (or juncture) of the surface that defines the outside diameter of the drill and the nose cutting edge, which has an angular orientation relative to the longitudinal axis a—a of the drill, is not overhoned. FIGS. 11 and 12 show the absence of overhoning. This absence of overhoning is especially apparent when one compares the condition of the juncture in FIGS. 6 and 7 with the corresponding location in FIGS. 11 and 12. The honing process of the invention does not remove too much material at the intersection, but instead, removes only enough material to hone the sharp cutting edge without overhoning. By the honing process of the invention, the intersection (or juncture) still keeps its sharpness.

Referring to the operation of the honing apparatus 50, the first nozzle 62 is positioned at an attack angle"" so that it directs the abrasive fluid stream toward the sharp nose cutting edges 126 of the drill 59. During the emission of the abrasive fluid stream, the chuck assembly rotates the drill 59 and the piston-cylinder arrangement moves the nozzle 62 in a direction that is generally parallel to the axial length of the drill 59. The first microprocessor 84 coordinates the movement of the nozzle 62 relative to the drill 59 so that the abrasive fluid stream uniformly impinges upon the nose cutting edges 126 for a preselected duration.

The second nozzle 92 has an orientation (attack angle"") such that it directs the abrasive fluid stream toward the sharp continuous cutting edge that is in the elongate body of the drill 59. During the emission of the abrasive fluid stream, the chuck assembly rotates the drill 59 and the piston-cylinder arrangement moves the nozzle 92 in a direction that is generally parallel to the axial length of the drill 59. The second microprocessor coordinates the movement of the nozzle 92 relative to the drill 59 so that the abrasive fluid stream uniformly impinges upon the continuous cutting edges 94 for a preselected duration.

In regard to the microprocessors 84, 104, the control of the honing operation by these microprocessors is known to those skilled in the art. The microprocessors are able to take the signal inputs regarding the relative position and movement of the nozzle and the drill, and then control these relative movements so as to provide for the proper extent of impingement of the abrasive stream on the appropriate cutting edge.

Once the drill has been honed it is in a condition to be used either with or without a coating. In this regard, typical coatings include hard refractory coatings such as, for example, titanium carbide, titanium nitride, titanium carbonitride, diamond, cubic boron nitride, alumina and boron carbide. The coating scheme can comprise a single layer or multiple layers. The coating scheme can comprise layers applied by chemical vapor deposition (CVD) or physical vapor deposition (PVD). The scheme can also include at least one layer applied by CVD and at least one layer applied by PVD.

The patents and other documents identified herein are hereby incorporated by reference herein.

Other embodiments of the invention will be apparent to those skilled in the art from a consideration of the specification or practice of the invention disclosed herein. It is intended that the specification and examples be considered as illustrative only, with the true scope and spirit of the invention being indicated by the following claims.

What is claimed is:

1. A method of treating at least one elongate rotary tool that has at least one nose portion that presents at least one sharp cutting edge and an elongate portion that presents at least one other sharp cutting edge, the method comprising the steps of:

emitting under pressure from a nozzle assembly an abrasive fluid stream comprising at least one abrasive entrained in at least one liquid; and impinging the abrasive fluid stream against the sharp cutting edges of the elongate rotary tool for a preselected time so as to transform the sharp cutting edges into relatively uniformly honed edges.

2. The method of claim 1 wherein the impinging step includes moving the nozzle assembly and the elongate rotary tool relative to each other so that the abrasive fluid stream impinges the entire length of the at least one sharp cutting edge.

3. The method of claim 1 wherein the impinging step includes moving the nozzle assembly and the elongate rotary tool relative to each other so that the abrasive fluid stream impinges the entire length of the at least one other sharp cutting edge.

4. The method of claim 1 further including the step of positioning the nozzle assembly relative to the elongate rotary tool prior to emitting the abrasive fluid stream.

5. The method of claim 1 further including the step of coating the elongate rotary tool after the transformation of at least one sharp cutting edge with one or more layers of a wear resistant coating material.

6. The method of claim 2 wherein:

the emitting step includes emitting under pressure from a first nozzle a first abrasive fluid stream comprising at least one abrasive and at least one liquid, and emitting under pressure from a second nozzle a second abrasive fluid stream comprising the at least one abrasive and the at least one liquid, and the impinging step includes impinging the first abrasive fluid stream against the at least one sharp cutting edge of the elongate rotary tool so as to transform the at least one Sharp cutting edge into a relatively uniformly honed at least one cutting edge, and impinging the second abrasive fluid stream against the at least one other sharp cutting edge of the elongate rotary tool so as to transform the at least one other sharp cutting edge into a relatively uniformly honed at least one other cutting edge.

7. The method of claim 6 wherein the impinging step further includes moving the elongate rotary tool relative to the first nozzle so that the first abrasive stream impinges the entire length of the at least one other cutting edge.

8. The method according to claim 1, wherein the at least one other sharp cutting edge comprises a sharp continuous cutting edge.

9. The method of claim 6 wherein the impinging step further includes rotating the elongate rotary tool relative to the second nozzle and longitudinally moving the second nozzle relative to the elongate rotary tool so that the second abrasive stream impinges the entire length of the at least one other cutting edge.

10. The method of claim 1 wherein the elongate rotary tool presents a peripheral surface that intersects with the at least one sharp cutting edge to define a sharp intersection therebetween, and the impinging step transforming the sharp intersection into a relatively uniformly honed intersection that retains a degree of sharpness.

11. The method of claim 1 wherein the at least one abrasive includes alumina particulates and the at least one liquid includes water.

12. The method of claim 1 wherein the elongate rotary tool further presents at least one as-ground surface that contains grinding marks, and the impinging step further includes impinging the abrasive fluid stream against the at least one as-ground surface so as to remove a substantial amount of the grinding marks.

13. An apparatus for treating at least one elongate rotary tool that has a nose portion that presents at least one sharp cutting edge and an elongate portion that presents at least one other sharp cutting edge, the apparatus comprising:

at least one fixture releasably holding the at least one elongate rotary tool;

at least one nozzle assembly being in communication with at least one source of an abrasive slurry comprising at least one abrasive entrained in a liquid so as to be able to emit under pressure an abrasive stream; and the at least one nozzle assembly and the at least one elongate rotary tool being moveable relative to each other so that during the emission of the abrasive stream the abrasive stream impinges the entire length of the sharp cutting edges so as to transform the sharp cutting edges into relatively uniformly honed cutting edges.

14. The apparatus of claim 13 wherein the at least one nozzle assembly is positionable relative to the at least one elongate rotary tool so as to define an angle of attack of the abrasive stream relative to the at least one sharp cutting edge of the at least one elongate rotary.

15. The apparatus of claim 13 wherein the at least one nozzle assembly is positionable relative to the at least one elongate rotary tool so as to define an angle of attack of the abrasive stream relative to the at least one other sharp cutting edge of the at least one elongate rotary.

16. The apparatus of claim 13 wherein the at least one nozzle assembly includes a first nozzle being in communication with the at least one source of the abrasive slurry so as to be able to emit under pressure a first abrasive steam, and the at least one elongate rotary tool being rotatable relative to the first nozzle so that during the emission of the first abrasive stream the first abrasive stream impinges the entire length of the at least one sharp cutting edge so as to transform the at least one sharp cutting edge into a relatively uniformly honed at least one cutting edge;

the at least one nozzle assembly further includes a second nozzle being in communication with the at least one source of the abrasive slurry so as to be able to emit under pressure a second abrasive steam, and the at least one elongate rotary tool being rotatable relative to the second nozzle and the second nozzle being movable along the length of the at least one elongate rotary tool so that during the emission of the second abrasive stream the second abrasive stream impinges the entire length of the at least one other sharp cutting edge so as to transform the at least one other sharp cutting edge into a relatively uniformly honed at least one other cutting edge.

17. The apparatus of claim 16, wherein the at least one other sharp cutting edge comprises a sharp continuous cutting edge.

18. The apparatus of claim 16 wherein the at least one elongate rotary tool further includes at least one peripheral surface that intersects with the at least one sharp cutting edge so as to define at least one sharp intersection; and the at least one elongate rotary tool being movable relative to the at least one nozzle assembly so that during the emission of the first and second abrasive streams, the first abrasive stream or the second abrasive stream or the first abrasive stream and the second abrasive stream impinge the at least one sharp intersection so as to transform the at least one sharp intersection into a relatively uniformly honed at least one intersection which retains a degree of sharpness.

19. The apparatus of claim 16 wherein the first nozzle is positionable relative to the at least one elongate rotary tool so as to define a first angle of attack of the first abrasive stream relative to the at least one elongate rotary tool.

20. The apparatus of claim 16 wherein the second nozzle is positionable relative to the at least one elongate rotary tool so as to define a second angle of attack of the second abrasive stream relative to the at least one elongate rotary tool.

21. The apparatus of claim 13 wherein the at least one elongate rotary tool presents at least one as-ground surface that contains grinding marks, and the at least one nozzle assembly and the at least one elongate rotary tool being movable relative to each other so that during the emission of the abrasive stream the abrasive stream impinges the at least one as-ground surface so as to remove a substantial number of the grinding marks.

* * * * *